US011434650B2

(12) United States Patent
Clark et al.

(10) Patent No.: US 11,434,650 B2
(45) **Date of Patent: *Sep. 6, 2022**

(54) MODULAR WALLED SPA AND METHOD OF CONSTRUCTION

(71) Applicant: Consolidated Manufacturing International, LLC, Raleigh, NC (US)

(72) Inventors: Reuben E. Clark, Cary, NC (US); Gary Weise, San Juan Capistrano, CA (US)

(73) Assignee: Consolidated Manufacturing International, LLC, Raleigh, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/171,606

(22) Filed: Feb. 9, 2021

(65) Prior Publication Data

US 2021/0164250 A1 Jun. 3, 2021

Related U.S. Application Data

(63) Continuation of application No. 16/446,276, filed on Jun. 19, 2019, now Pat. No. 10,914,089.

(60) Provisional application No. 62/687,205, filed on Jun. 19, 2018.

(51) Int. Cl.

| | |
|---|---|
| ***E04H 4/00*** | (2006.01) |
| ***E04G 17/065*** | (2006.01) |
| ***A47K 3/02*** | (2006.01) |
| *E04G 9/04* | (2006.01) |

(52) U.S. Cl.

CPC ..... *E04H 4/0081* (2013.01); *A47K 3/02* (2013.01); *E04G 17/0658* (2013.01); *E04G 9/04* (2013.01)

(58) Field of Classification Search

CPC ..... E04H 4/0081; A47K 3/02; E04G 17/0658
USPC ..... 4/593
See application file for complete search history.

(56) References Cited

U.S. PATENT DOCUMENTS

| | | | | |
|---|---|---|---|---|
| 2,873,505 | A * | 2/1959 | Sheldon | E04G 11/062 264/34 |
| 3,592,435 | A * | 7/1971 | Mattingly | E04G 9/05 249/1 |
| 3,643,908 | A | 2/1972 | Laing | |
| 3,808,761 | A | 5/1974 | Green et al. | |
| 3,832,814 | A | 9/1974 | Teschner | |
| 5,111,628 | A | 5/1992 | Desjoyaux et al. | |
| 5,531,352 | A | 7/1996 | Kraft | |
| 5,791,098 | A | 8/1998 | Thomas | |
| 7,784,227 | B2 | 8/2010 | Ribeiro | |
| 7,802,324 | B2 | 9/2010 | Layfield et al. | |
| 8,225,577 | B1 | 7/2012 | Fender | |
| 9,175,471 | B2 | 11/2015 | Ting | |

(Continued)

*Primary Examiner* — Huyen D Le
(74) *Attorney, Agent, or Firm* — Michael Best & Friedrich LLP

(57) ABSTRACT

Systems and methods for modular walled systems, such as modular walled spas and modular walled privacy fences and can protect pool and spa equipment from the public. In one embodiment, the modular walled system includes an outer frame disposed within a medial frame, and an inner frame disposed within the medial frame, wherein each frame includes a set of brace assemblies that connect to rebar grids. The brace assemblies may include a foot plate and threaded couplers. The wall system also provides protective room for electrical raceways and a secure anchor substrate to attach electronics, panels, boxes or lighting systems.

20 Claims, 18 Drawing Sheets

(56) References Cited

U.S. PATENT DOCUMENTS

| | | | | |
|---|---|---|---|---|
| 10,914,089 | B2 * | 2/2021 | Clark | A47K 3/02 |
| 2004/0168390 | A1 | 9/2004 | Desjoyaux et al. | |
| 2018/0135318 | A1 * | 5/2018 | Crosby | E04G 17/0658 |

* cited by examiner

MODULAR WALLED SPA AND METHOD OF CONSTRUCTION

CROSS-REFERENCE TO RELATED APPLICATIONS

This application is a continuation of co-pending U.S. patent application Ser. No. 16/446,276, filed Jun. 19, 2019, which claims priority to U.S. Provisional Patent Application No. 62/687,205, filed on Jun. 19, 2018, the entire content of each of which is incorporated herein by reference.

FIELD

The disclosure relates generally to modular walled systems and methods of construction of modular walled systems, such as modular walled spas.

BACKGROUND

Traditional construction of walled systems can be labor intensive and relatively costly, due to in-situ construction difficulties and processes, and can present wide variation in quality and standards. Such challenges are heightened in the construction of spa systems, given, for example, the additional requirements associated with constructing a structure holding a volume of water. The water volume must be, for example, water tight and produces a significant structural load on the spa structure.

SUMMARY

The present disclosure solves the limitations of existing walled systems for spa structures by utilizing a modular construction approach, among other things. The present disclosure can provide a number of advantages depending on the particular aspect, embodiment, and/or configuration.

The disclosure involves modular wall systems and methods of installation. In certain embodiments, the present disclosure involves modular walled spa systems and methods of modular walled spa construction and installation. The disclosure also involves modular walled privacy fences that can protect pool and spa equipment from people and people from the pool and spa equipment, providing both privacy protection and equipment protection.

In one embodiment, a modular walled spa system is disclosed, the system comprising: an outer frame comprising an outer frame outer panel, an outer frame inner panel, an outer frame rebar grid, and a set of brace assemblies connecting the outer frame panel, the outer frame inner panel, and the outer frame rebar grid, the outer frame defining an outer perimeter; a medial frame comprising a medial frame outer panel, a medial frame inner panel, a medial frame rebar grid and a set of brace assemblies connecting the medial frame panel, the medial frame inner panel, and the medial frame rebar grid, the medial frame defining a medial perimeter smaller than the outer perimeter; and an inner frame comprising an inner frame outer panel, an inner frame rebar grid, and a set of brace assemblies connecting the inner frame outer panel and the inner frame rebar grid, the inner frame defining an inner perimeter smaller than the medial perimeter; wherein: each of the brace assemblies comprise a riser plate and a foot plate.

In some embodiments, each of the brace assemblies further comprises at least two threaded couplers with an outer free floating non-metallic spacer tube, creating a, for example, ⅜" inch space for the metallic circumference and the finish wall to be later filled with an epoxy or other material to prevent corrosion or contact with finished substrate material. In another aspect, the outer frame rebar grid is positioned between the outer frame outer panel and the outer frame inner panel. In another aspect, the medial frame rebar grid is positioned between the medial frame outer panel and the medial frame inner panel. In another aspect, the system is configured to receive poured concrete.

In another embodiment, the present disclosure provides a modular walled spa system including an outer panel, an inner panel spaced from the outer panel to define a volume between the inner panel and the outer panel, a rebar grid disposed in the volume between the outer panel and the inner panel, and a plurality of coupler assemblies connecting the outer panel and the inner panel. Each coupler assembly of the plurality of coupler assemblies includes a threaded coupler having a first end and a second end opposite the first end, a first spacer surrounding a first portion of the threaded coupler, a second spacer surrounding a second portion of the threaded coupler, a first bolt threadably coupled to the first end of the threaded coupler and configured to secure the inner panel to the first end of the threaded coupler, and a second bolt threadably coupled to the second end of the threaded coupled and configured to secure the outer panel to the second end of the threaded coupler.

In another embodiment, the present disclosure provides a modular walled spa system including an outer panel, an inner panel spaced from the outer panel to define a volume between the inner panel and the outer panel, a rebar grid disposed in the volume between the outer panel and the inner panel, and a plurality of coupler assemblies connecting the outer panel and the inner panel. Each coupler assembly of the plurality of coupler assemblies includes a threaded coupler having a first end and a second end opposite the first end, a first spacer surrounding a first portion of the threaded coupler, a second spacer surrounding a second portion of the threaded coupler, a first bolt threadably coupled to the first end of the threaded coupler and configured to secure the inner panel to the first end of the threaded coupler, and a second bolt threadably coupled to the second end of the threaded coupled and configured to secure the outer panel to the second end of the threaded coupler.

Embodiments of the present disclosure may comprise a kit having an engineered plan, 3D colored rendering for Homeowner/Contractor visualization, excavation layout template, jets, wall forms, steel and structural uprights, screws, corner braces, safety drains, umbrella cup, grounding/bonding clamps and split bolts, a equipotential perimeter grid (which can be 50 feet) #8 bare copper (which can be 50 feet), decorative rock for bottom of catch basin, exit plates (trough and seat one time use) after concrete placement, a clear acrylic safety cover, water features, lighting, water leveler, additional jets, pumps, filter, heater, automation components, solar panels, gas package comprising gas risers, gas cocks, PE fusion fittings. In certain embodiments, the steel and structural uprights can have dimensions ranging from 1½ inches by ⅜ of an inch to 3 inches by ⅜ of an inch.

Certain embodiments of the present disclosure are directed to methods of installation and/or construction of a modular wall.

In an exemplary embodiment, a method for installation of a modular walled spa systems and methods of modular walled spa construction and installation are disclosed. Installation of the modular walled spa is performed on a code compliant site based on a property line and equipment offsets. In certain embodiments, the depth can be 18 inches or more. The modular components allow the modular walled spa to be shipped and delivered on a pallet next to the construction area where the spa walls will be installed. Certain embodiments comprise leveling a pad, securing the pad with rebar stakes in the desired configuration for the spa; excavating a certain depth for placement of the spa; leveling a top layout form in excavation depth; leveling an outside wall for a catch basin, which can further comprising using sand or gravel to level; leveling a floor for a wall footpad placement as needed; digging a trench, where the trench can have dimensions of 24 inches by 24 inches; assembling a first wall (e.g, an interior wall of a spa) leaving an area for exit and entry; assembling a second wall (e.g. a catch basin wall); leveling the second wall; assembling a third wall (e.g. a seating wall); leveling the third wall; installing corner braces (prior to applying concrete); plumbing a jet manifold in a seat; installing jets into a main spa wall; installing jets into the seating area; completing floor, wall and corner steel placement by utilizing a bottom horizontal wall rebar to place and tie the floor steel; and applying concrete. The concrete can be applied by pouring concrete or pneumatically applied.

In certain embodiments, the walls are numbered in the sequence they are installed. In certain embodiments, walls and seats have pre-designated circular saw hole points for 1" jet piping. Certain embodiments comprise a kit having ⅜ pre-cut steel rebar pieces including transition and corner overlays. Certain embodiment comprise free standing walls, allowing leveling with shims under a footplate spine so corner braces can be securely fastened.

In certain embodiments, the jets installed in the main spa wall are 90-degree jets and the jets installed into the seating area are straight jets. Because wall panels can be removed, there is greater access to the plumbing area.

Embodiments can further comprise spreading dirt in planters and landscaping as part of the method of installation.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible utilizing, alone or in combination, one or more of the features set forth above or described in detail below. Also, while the disclosure is presented in terms of exemplary embodiments, it should be appreciated that individual aspects of the disclosure can be separately claimed.

BRIEF DESCRIPTION OF THE DRAWINGS

The disclosure will be readily understood by the following detailed description in conjunction with the accompanying drawings, wherein like reference numerals designate like elements.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Also, it is to be understood that the phraseology and terminology used herein is for the purpose of description and should not be regarded as limiting.

The word "modular" means composed of standardized units or sections that facilitate manufacturing and/or construction.

The phrase "modular construction" means construction using modular components.

The phrases "at least one," "one or more," and "and/or" are open-ended expressions that are both conjunctive and disjunctive in operation. For example, each of the expressions "at least one of A, B and C"; "at least one of A, B, or C"; "one or more of A, B, and C"; "one or more of A, B, or C"; and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

The terms "determine," "calculate," and "compute," and variations thereof as used herein are used interchangeably and include any type of methodology, process, mathematical operation or technique.

The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

DETAILED DESCRIPTION

Figure 1A:
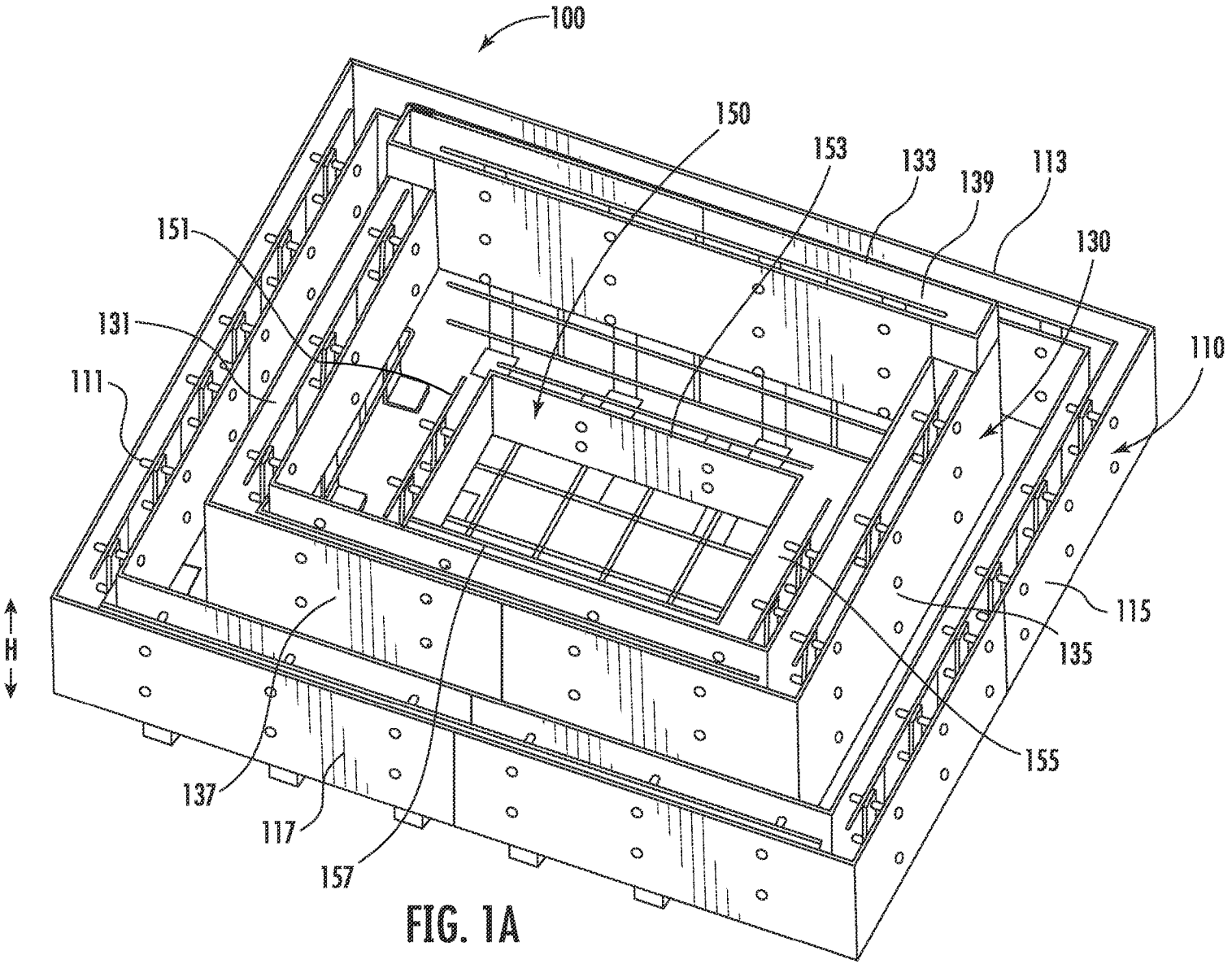
FIG. 1A shows a perspective view of a modular spa frame according to embodiments of the present disclosure.

The following disclosure generally relates to modular walled systems and methods of construction of modular walled systems, such as modular walled spas. FIG. 1A illustrates a modular spa frame 100 according to one embodiment. The illustrated modular spa frame 100 includes an outer frame 110, a medial frame 130, and an inner frame 150. Each of the frames 110, 130, 150 is rectangular in the illustrated embodiment. In particular, the outer frame 110 includes a first side 111, a second side 113, a third side 115, and a fourth side 117. The first side 111 is parallel to the third side 115, and the second side 113 is parallel to the fourth side 117. Likewise, the medial frame 130 includes a first side 131, a second side 133, a third side 135, and a fourth side 137, and the inner frame 150 includes a first side 151, a second side 153, a third side 155, and a fourth side 157. In other embodiments, the frames 110, 130, 150 may include different numbers of sides to define other shapes, such as square, hexagonal, and octagonal shapes.

Figure 1B:
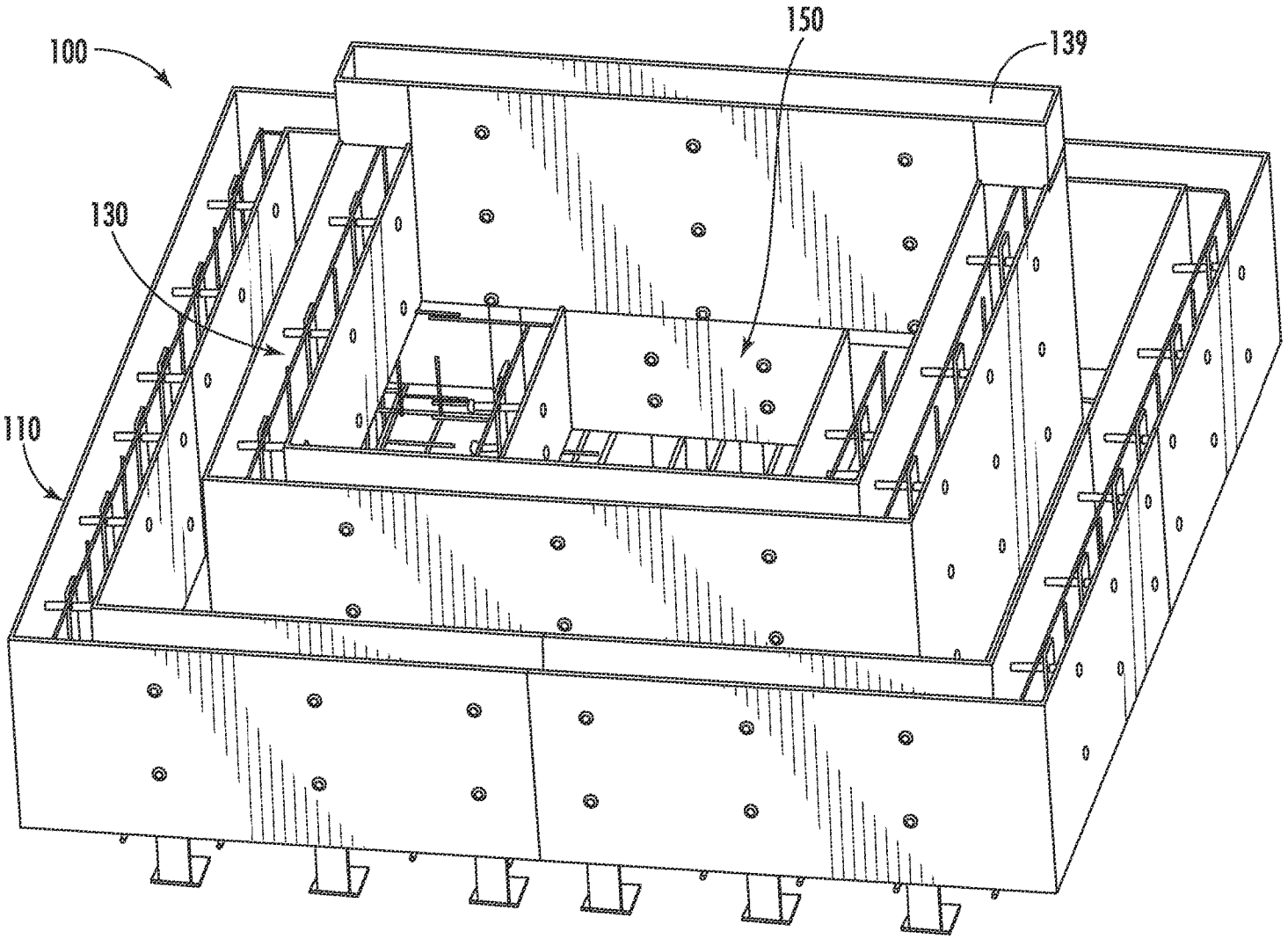
FIG. 1B is a perspective view of a square modular spa frame according to embodiments of the present disclosure.
Figure 2A:
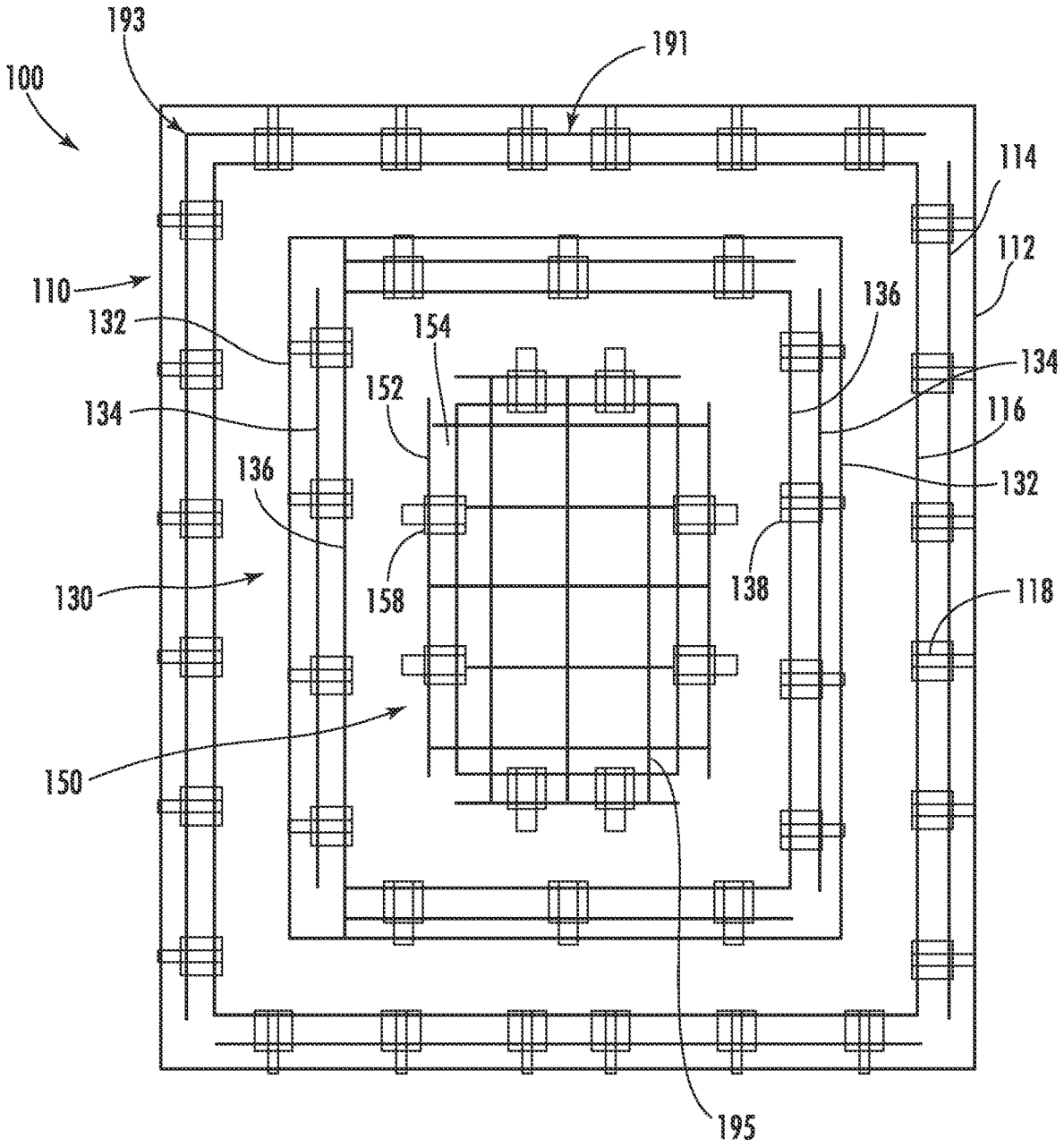
FIG. 2A is a top view of the modular spa frame of FIG. 1A.
Figure 2B:
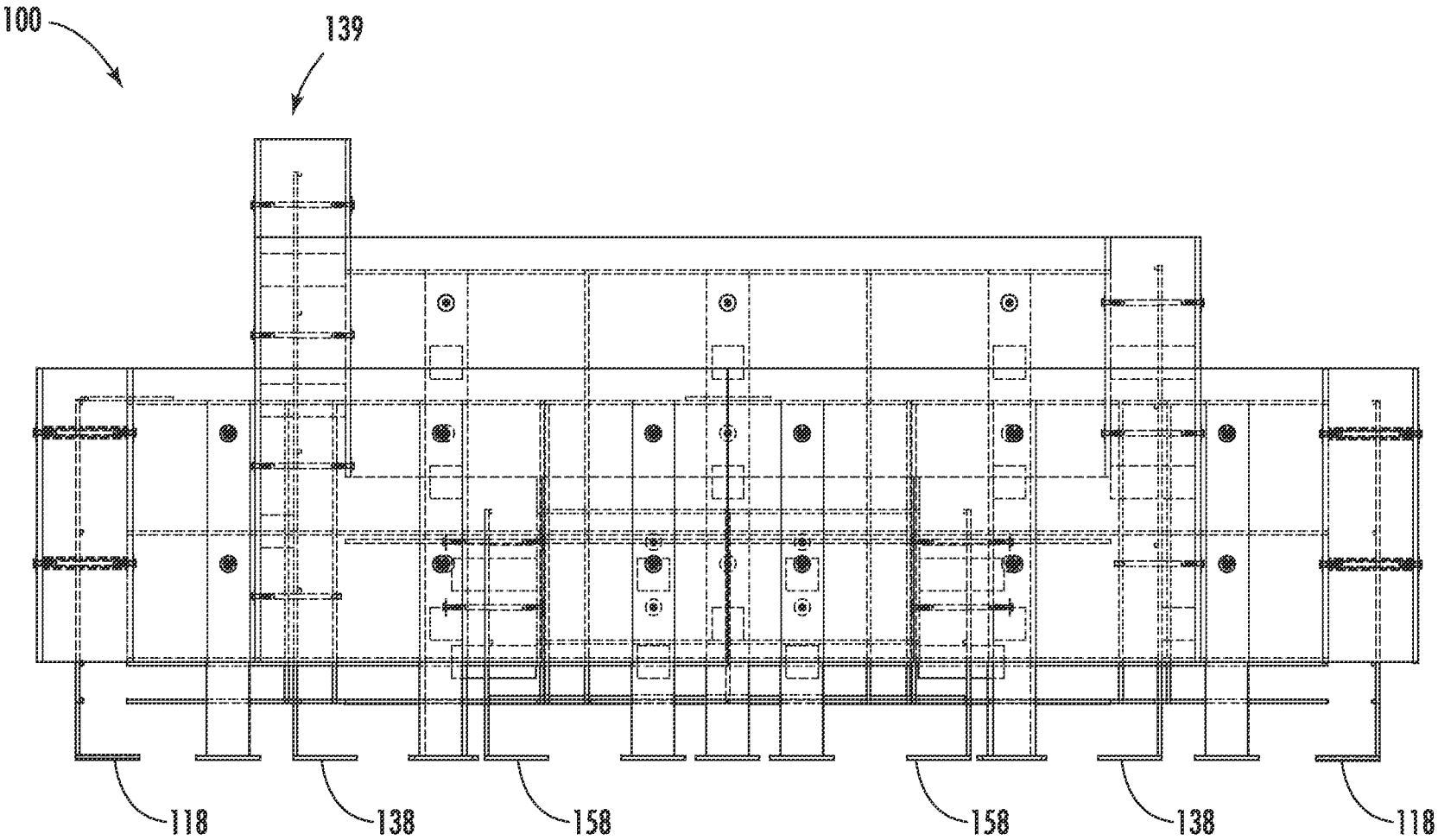
FIG. 2B is a left side cut-away view of the modular spa frame of FIG. 1A.
Figure 2C:
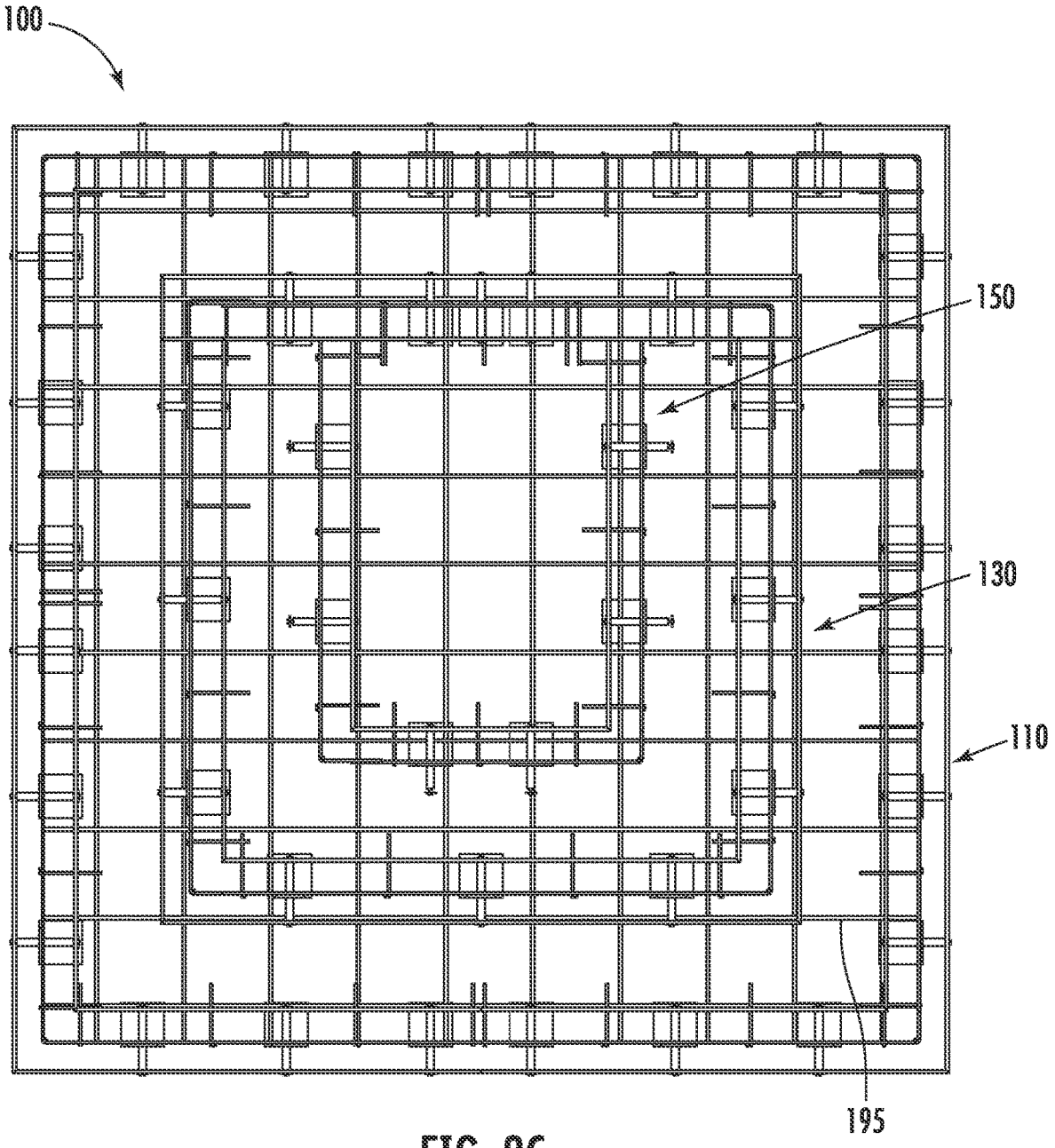
FIG. 2C is a top view of the square modular spa frame of FIG. 1B.

For example, FIGS. 1B and 2C illustrate the modular spa frame 100 having a square footprint. In such embodiments, each of the frames 110, 130, 150 may be shaped as a square. In one embodiment, the square footprint formed by the modular spa frame 100 is six feet in length per side. Other sizes are possible, such as eight feet in length per side, ten feet in length per side, and the like.

Referring to FIG. 1A, the frames 110, 130, 150 are nested within one another. Specifically, the outer frame 110 defines the largest and outermost rectangle of the modular spa frame 100. The inner frame 150 defines the smallest and innermost rectangle of the modular spa frame 100. The medial frame 130 defines an intermediate rectangle that is larger than the inner frame 150 and smaller than the outer frame 110. As such, the first sides 111, 131, 151 of each frame 110, 130, 150 are parallel, the second sides 113, 133, 153 of each frame 110, 130, 150 are parallel, the third sides 115, 135, 155 of each frame 110, 130, 150 are parallel, and the fourth sides 117, 137, 157 of each frame 110, 130, 150 are parallel.

The medial frame 130 is positioned inboard of the outer frame 110 relative to the overall modular spa frame 100, and the medial frame 130 is positioned outboard of the inner frame 150 relative to the overall modular spa frame 100. The term "inboard" means inside of an element or a device or toward the inside or inner part of an element or device relative to a larger system or device. The term "outboard" means outside of an element or a device or toward the outside or outer part of an element or device relative to a larger system or device. Thus, the medial frame 130 is positioned between the inner frame 150 and the outer frame 110.

Each of the outer frame 110, the medial frame 130, and the inner frame 150 defines a height measured in the direction of arrow H in FIG. 1A. In the illustrated embodiment of FIG. 1A, the heights of the outer frame 110 and the medial frame 130 are substantially the same, except for one portion 139 of the medial frame 130 that is of greater height. The height of the inner frame 150, is shorter than the height of the medial frame 130 and the outer frame 110. In other embodiments, the relative heights of the outer frame 110, medial frame 130, and inner frame 150 may differ.

The inner frame 150, which may also be referred to as a "Spine" of the modular spa frame 100, may be provided as a stand-alone system. For example, the inner frame 150 may be used independently of the outer frame 110 and medial frame 130 in several applications, including as a structure to secure or enclose equipment and/or to provide a privacy area. In some embodiments, a user (e.g., a contractor) may attach sheet material such as plywood to the inner frame 150 as a singular modular component for ease of concrete pouring with minimal labor and set up time. Such uses of the inner frame 150 advantageously provide an inexpensive and aesthetically-pleasing covering or hiding of an equipment area (such as, for example, a covering of a gas heater).

With reference to FIG. 2A, the outer frame 110 includes, from the outer most area of the modular spa frame 110 inwards, an outer frame outer panel 112, an outer frame rebar grid 114, and an outer frame inner panel 116. The outer frame 110 further comprises a plurality of outer frame brace assemblies 118 that are coupled to the outer frame outer panel 112, the outer frame rebar grid 114, and the outer frame inner panel 116.

The medial frame 110 includes, from the outer most area of the modular spa frame 110 inwards, a medial frame outer panel 132, a medial frame rebar grid 134, and a medial frame inner panel 136, The medial frame 110 further includes a plurality of medial frame brace assemblies 138 that are coupled to the medial frame outer panel 132, the medial frame rebar grid 134, and the medial frame inner panel 136.

The inner frame 150 includes, from the outer most area of the modular spa frame 110 inwards, an inner frame outer panel 152 and an inner frame rebar grid 154. The inner frame 150 further comprises a set of inner frame brace assemblies 158 that are coupled to the inner frame outer panel 152 and the inner frame rebar grid 154. In one embodiment, the inner frame outer panel 152 is made of rebar rather than a panel. In some embodiments, the inner frame 150 may further include an inner frame inner panel coupled to the inner frame outer panel 152 and the inner frame rebar grid 154.

The frame panels 112, 116, 132, 136, 152 may be made of any suitable sheet material. In some embodiments, the frame panels 112, 116, 132, 136, 152 are made of plywood. The plywood construction of the frame panels 112, 116, 132, 136, 152 allows a user constructing the modular walled spa 100 to cut any of the frame panels 112, 116, 132, 136, 152 to a desired size. In addition, plywood is relatively inexpensive and readily available at most jobsites.

The rebar grids 114, 134, 154 include multiple segments of steel rebar, which may be tied together by wire in various ways. For example, each rebar grid 114, 134, 154 may include one or more rebar straight ties 191 and one or more rebar corner ties 193. In the illustrated embodiment, a rebar floor grid 195 is disposed substantially within a perimeter defined by the inner frame 150 (FIG. 2A). In some embodiments, the rebar floor grid 195 may extend across substantially the entire interior area of the modular spa frame 100 (FIG. 2C). In some embodiments, other types of rebar may be used, such as composite rebar.

With reference to FIG. 2B, the heightened portion 139 of the medial frame 130 may be configured to accommodate a jet air line manifold system. Spa jets may expel a combination of air and water. The upper most portion of the air manifold must not be located under water to accomplish air entrainment and venturi action enabling the combination of air and water.

Figure 4A:
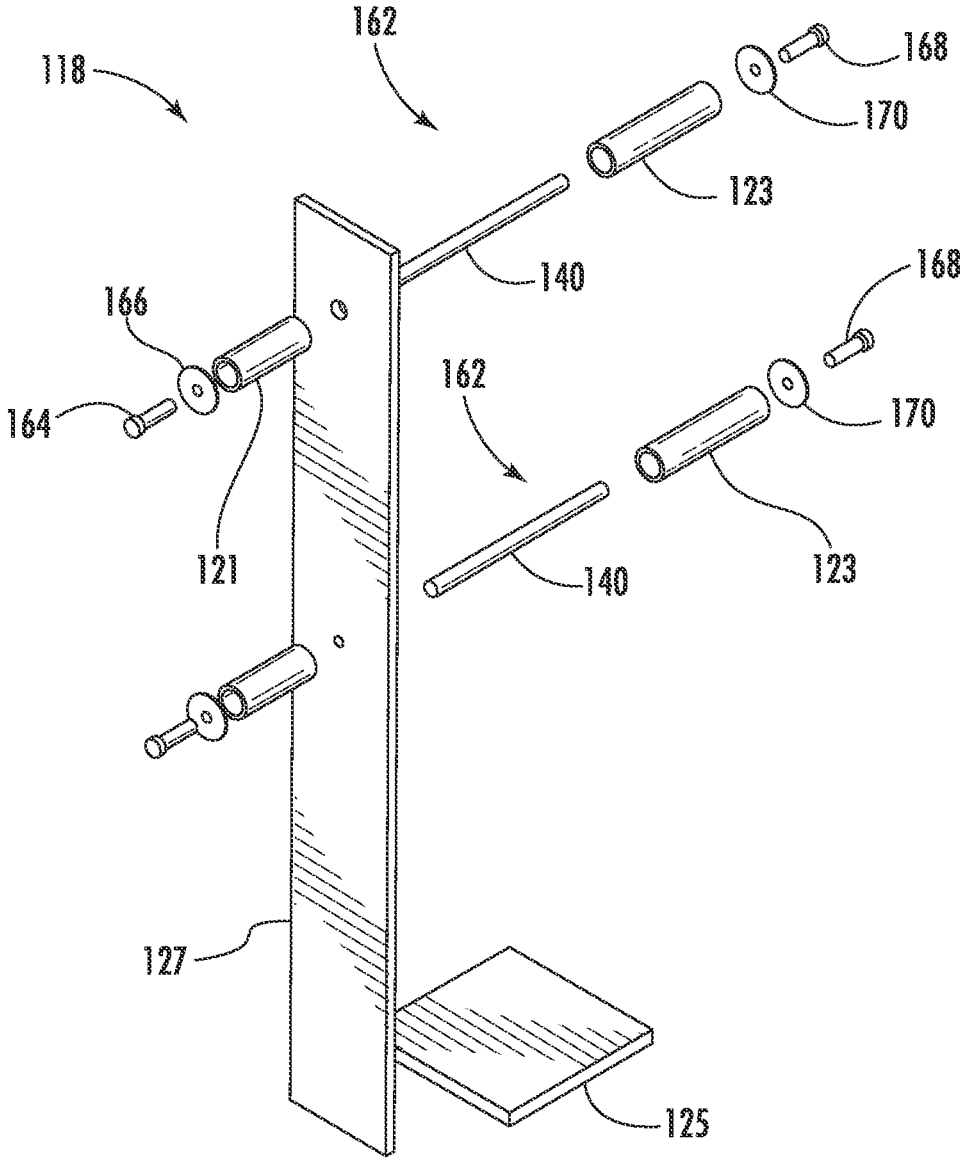
FIG. 4A is an exploded perspective view illustrating a brace assembly according to an embodiment of the disclosure.
Figure 4B:
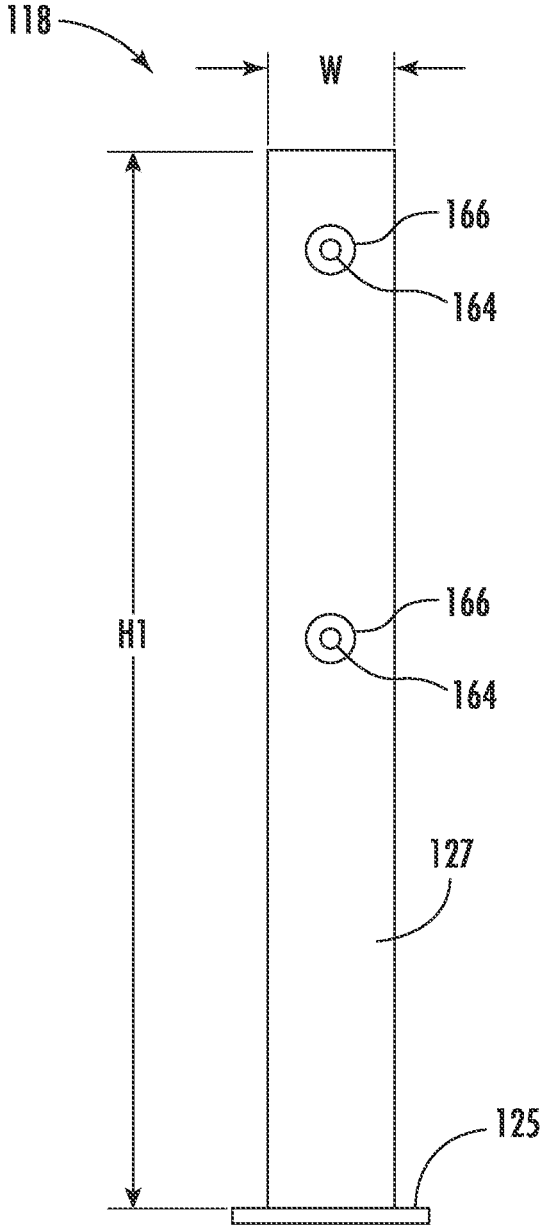
FIG. 4B is a front view of the brace assembly component of FIG. 4A.
Figure 4C:
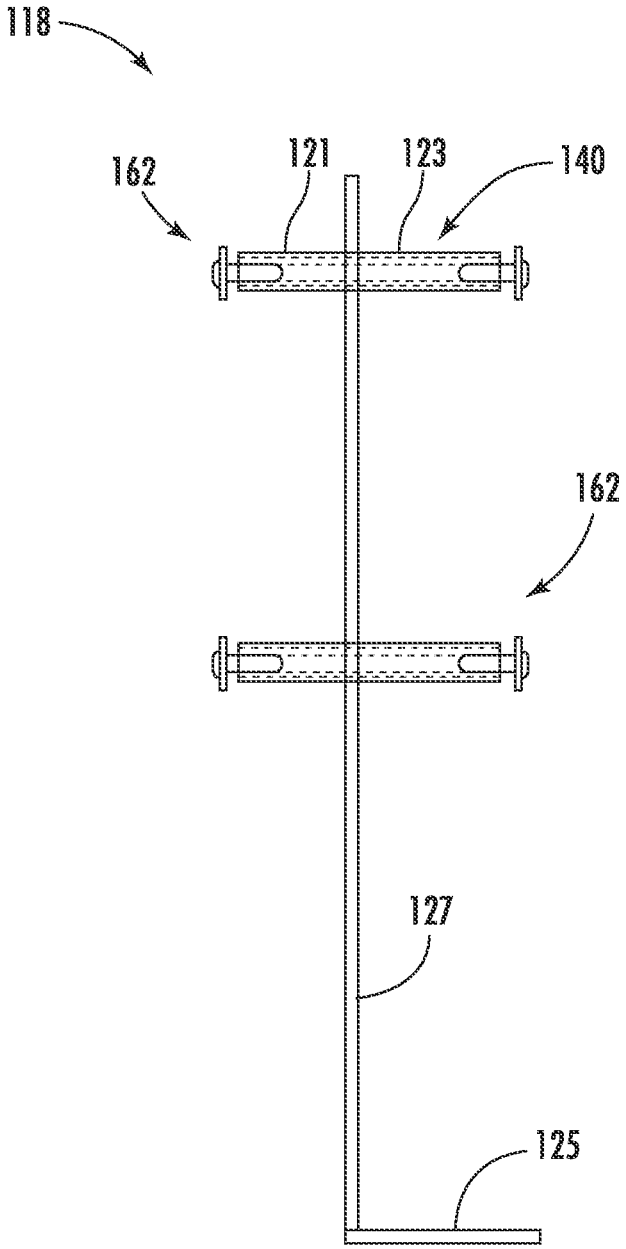
FIG. 4C is a left side view of the brace assembly component of FIG. 4A.

Each of the outer frame 110, medial frame 130, and inner frame 150 are at least partially supported by first, second, and third pluralities of brace assemblies 118, 138, and 158, respectively. A brace assembly 118 according to one embodiment is illustrated in FIGS. 4A-C. Each of the second and third brace assemblies 138, 158 may be substantially similar to the brace assembly 118 described and illustrated herein.

Figure 3A:
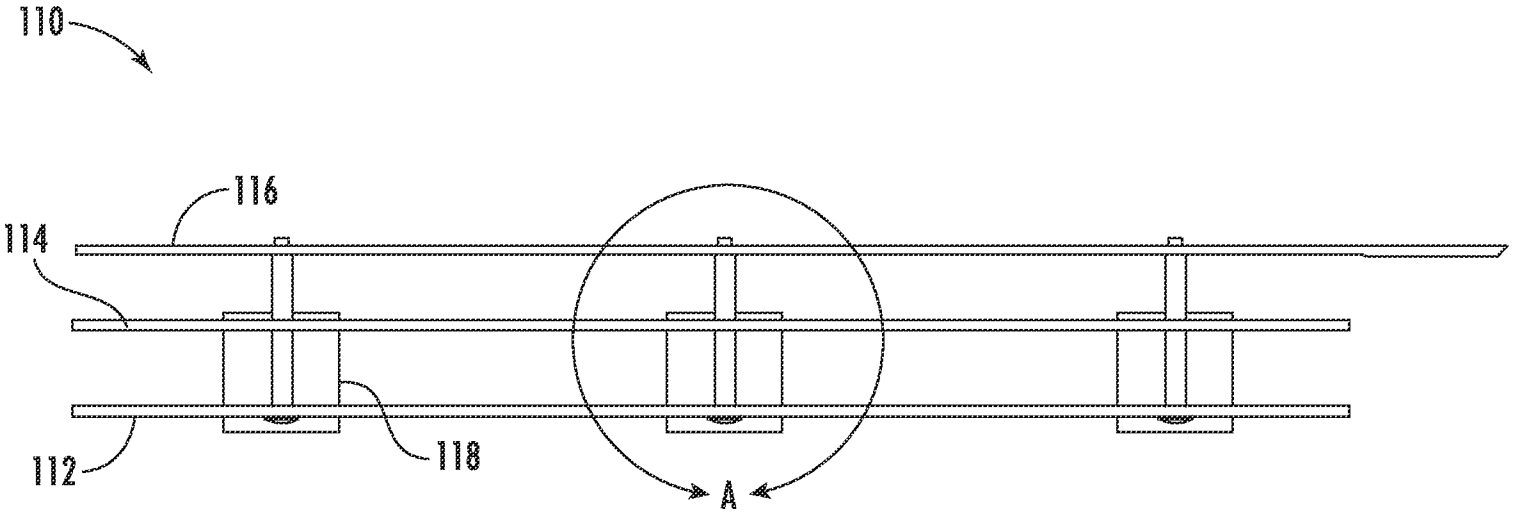
FIG. 3A is a top-view of a portion of the modular spa frame of FIG. 1A.
Figure 3B:
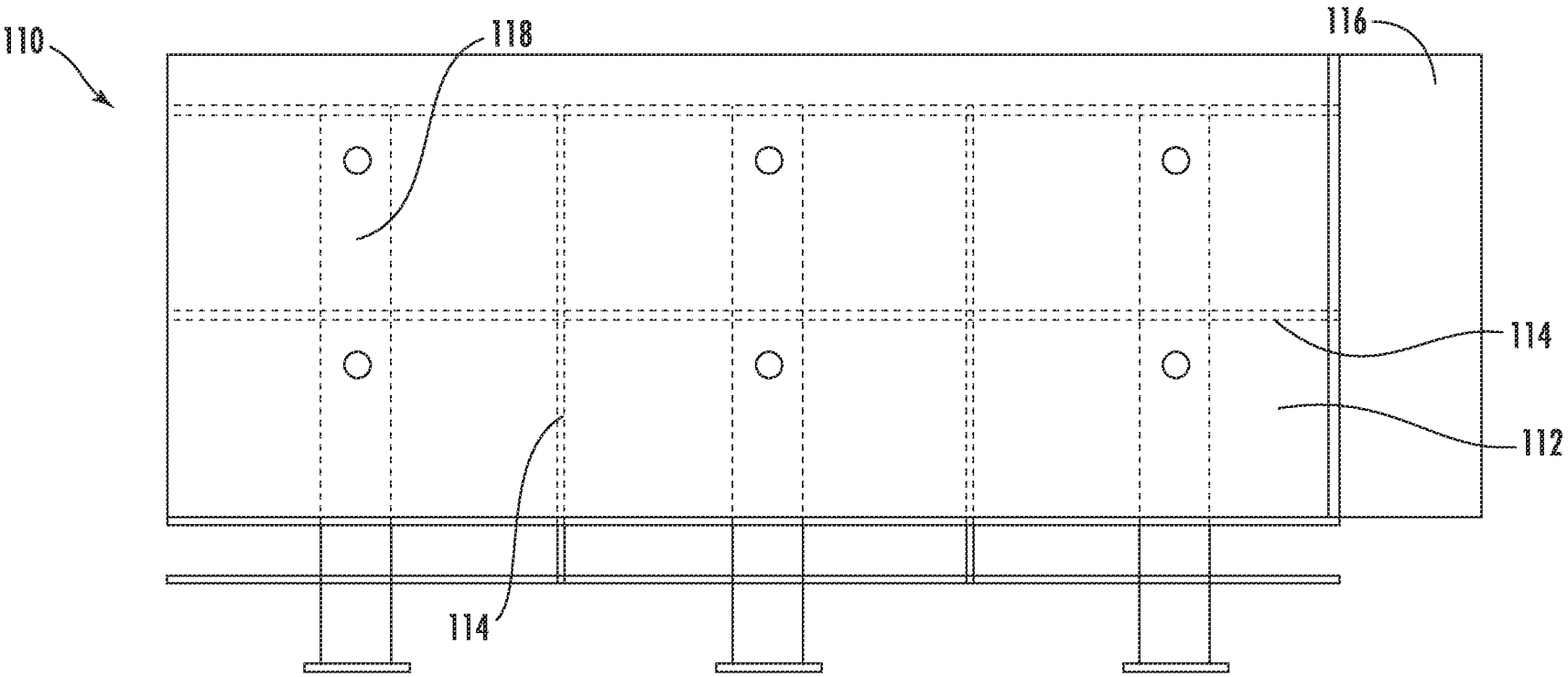
FIG. 3B is a side view of the portion of the modular spa frame of FIG. 3A.
Figure 3C:
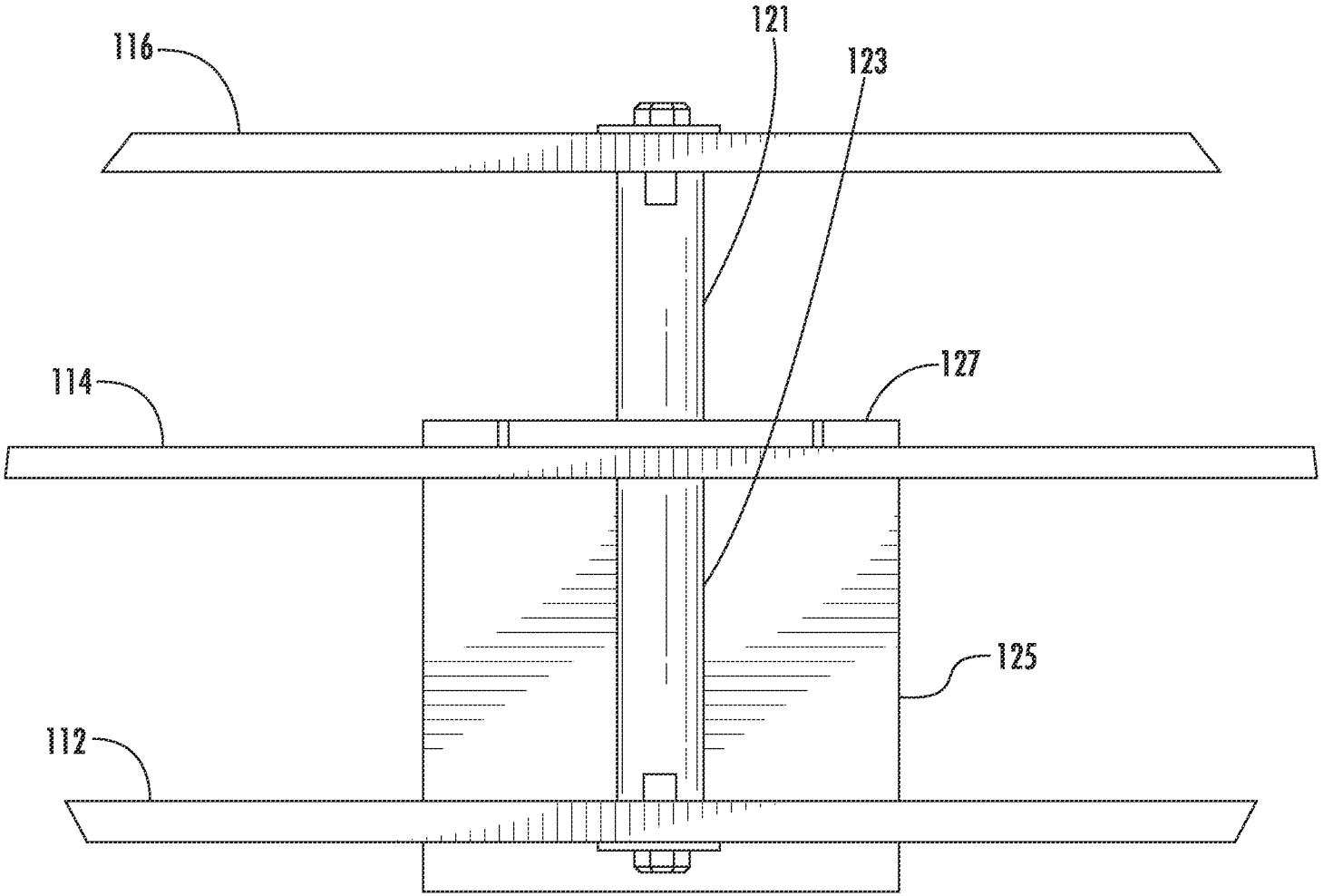
FIG. 3C is a detailed view of portion A-A of FIG. 3A.

Referring to FIGS. 3A-C, each of the outer frame brace assemblies 118 extends between the outer frame outer panel 112 and outer frame inner panel 116. Each assembly 118 includes an outer spacer 123 coupled between the outer frame outer panel 112 and the outer frame rebar grid 114, and a riser plate 127 coupled to the outer frame rebar grid 114. An inner spacer 121 is coupled between the outer frame inner panel 116 and the outer frame rebar grid 114.

Referring to FIGS. 4A-C, each of outer frame brace assembly 118 also includes a horizontal foot plate 125 coupled to the vertical riser plate 127. In some embodiments, the foot plate 125 may be welded to the riser plate 127. As illustrated in FIG. 4C, the riser plate 127 may be coupled to an end of the foot plate 125. In other embodiments, the riser plate 127 may be coupled to a center of the foot plate 125. In some embodiments, each of the riser plate 127 and the foot plate 125 is made of ⅜-inch thick steel. In some embodiments, the foot plate 125 is a six-inch by six-inch square. The riser plate 127 has a width W that is narrower than the foot plate 125. For example, in some embodiments, the riser plate 127 may have a width W of about 4-inches. In some embodiments, the riser plate 127 has a height H1 between about 20-inches and about 24-inches.

With continued reference to FIGS. 4A-C, each outer frame brace assembly 118 further includes a plurality of coupler assemblies 162. Each coupler assembly 162 extends from the riser plate 127 to connect the riser plate 127 to one or more of the outer frame outer panel 112, outer frame inner panel 116, and outer frame rebar grid 114. In the illustrated embodiment, each outer frame brace assembly 118 includes a pair of coupler assemblies 162, which are spaced along the height H1 of the riser plate 127 and vertically aligned with a center of the width W of the riser plate 127.

An inner spacer 121 extends in a first direction (i.e. toward the inner panel 116) from a first side of the riser plate 127, and an outer spacer 123 extends in a second, opposite direction (i.e. toward the outer panel 112) from a second, opposite side of the riser plate 127. A threaded coupler 140 extends through the riser plate 127 and through both spacers 121, 123 (FIG. 4C). The threaded coupler 140 includes a first threaded aperture 142 at a first end 141 of the threaded coupler 140, and a second threaded aperture 143 at a second end 144 of the threaded coupler 140. In the illustrated embodiment, each of the spacers 121, 123 is made of a non-metallic material, such as PVC. The coupler 140 is preferably made of steel.

In the illustrated embodiment, the threaded coupler 140 includes a first portion 146 including the first end 141 and a second portion 148 including the second end 143. The first portion 146 is smaller in diameter than the second portion 148 such that a shoulder 149 is defined at the interface between the two portions 146, 148. In some embodiments, the diameter of the first portion 146 is about 0.465-inches, and the diameter of the second portion 148 is about 0.50-inches. The threaded coupler 140 may be configured to telescope to extend or reduce the overall length of the threaded coupler 140 (i.e. the length from the first end 141 to the second end 143). In other embodiments, the first portion 146 and the second portion 148 may be fixed together. In some embodiments, the first portion 146 and the second portion 148 may be integrally formed together as a single piece. In such embodiments, the first portion 146 may be formed by machining away material along the first portion 146 to provide the reduced diameter of the first portion 146.

With reference to FIG. 4A, a first bolt 164 extends through a compatible first washer 166 and threadably engages the first threaded aperture 142. A second bolt 168 extends through a compatible second washer 170 and threadably engages the second threaded aperture 144. The first bolt 164 and the first washer 166 couple the inner panel 116 to the first end 141 of the threaded coupler 140, and the second bolt 168 and second washer 170 couple the outer panel 112 to the second end 143 of the threaded coupler 140. In this way, the coupler assembly 162 secures each of the outer panel 112 and the inner panel 116 to the riser plate 127, which in turn is secured to the rebar grid 114.

Figure 4D:
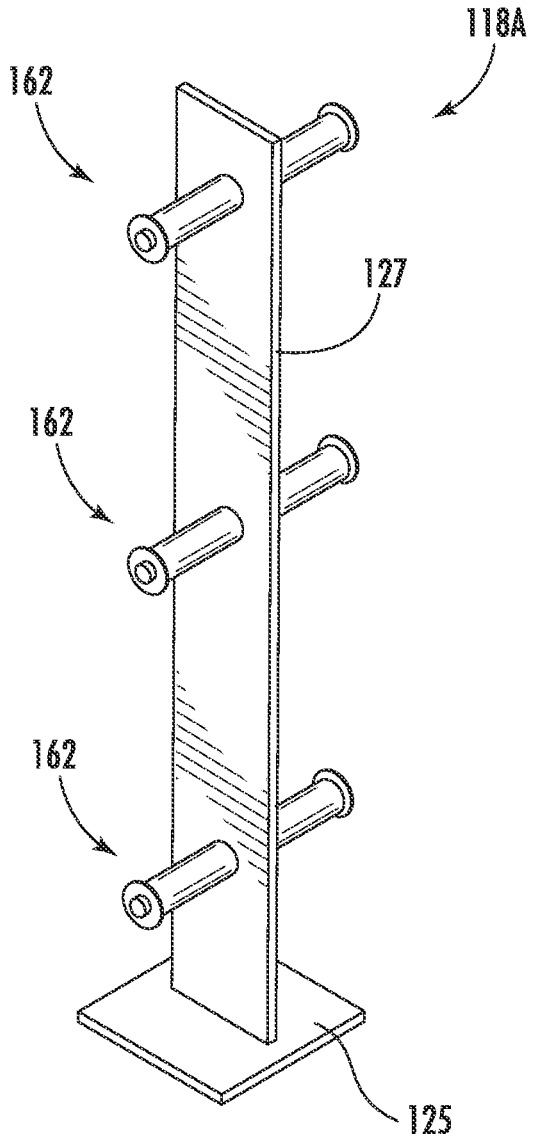
FIG. 4D is a perspective view illustrating a brace assembly according to another embodiment of the disclosure.

FIG. 4D illustrates a brace assembly 118A according to another embodiment. The brace assembly 118A may be substituted for one or more of the brace assemblies 118, 138, 158. The brace assembly 118A is similar to the brace assemblies 118 described above with reference to FIGS. 4A-4C, and like components are given corresponding reference numbers.

The brace assembly 118A includes three coupler assemblies 162 instead of two, therefore providing improved coupling strength to hold the inner panel 116 and the outer panel 112 together. The three coupler assemblies 162 are evenly spaced in a height direction of the riser plate 127 and are centered along the width of the riser plate 127. Furthermore, the riser plate 127 is centered on the foot plate 125 in the illustrated embodiment; however, the riser plate 127 may alternatively be coupled to an end of the foot plate 125.

Figure 4E:
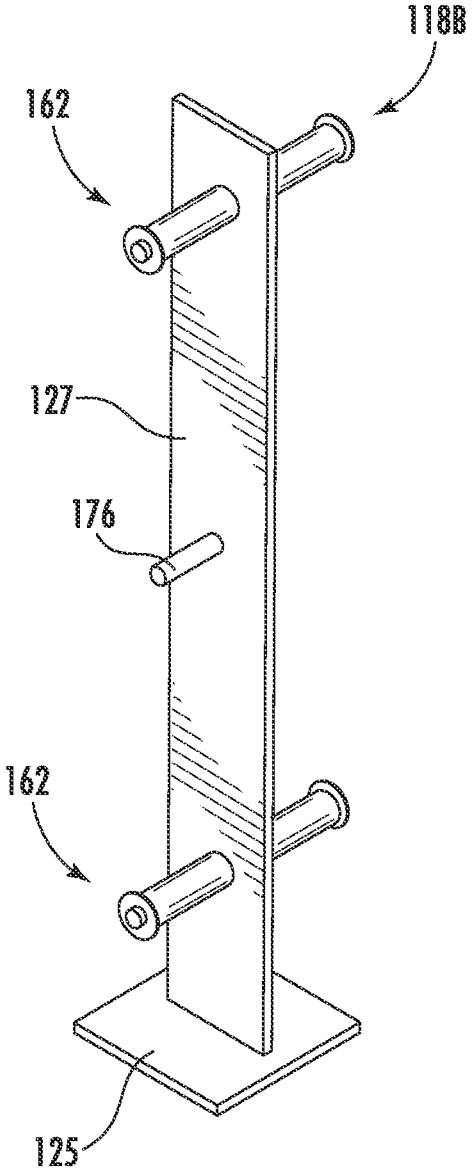
FIG. 4E is a perspective view illustrating a brace assembly according to another embodiment of the disclosure.
Figure 5A:
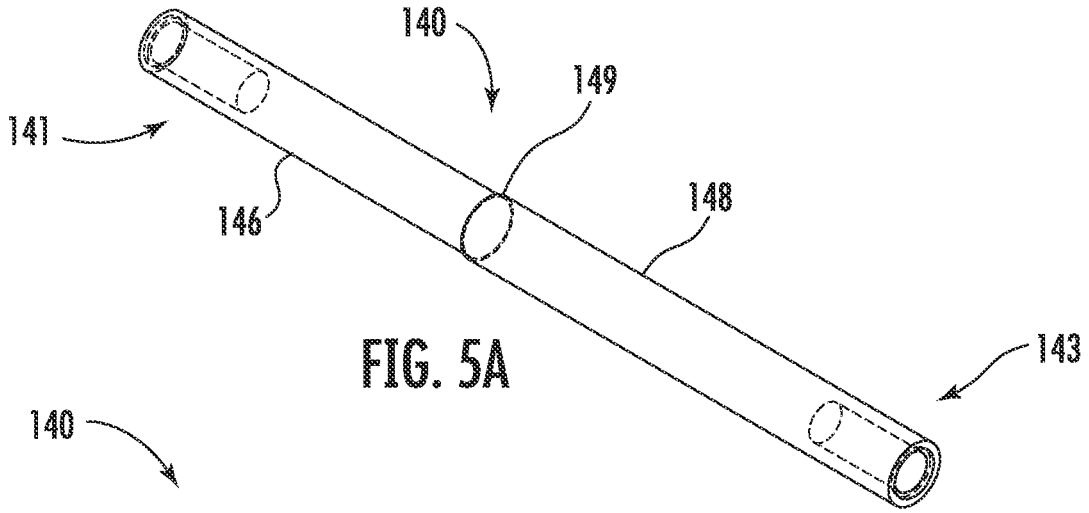
FIG. 5A is a perspective view of a threaded coupler according to an embodiment of the disclosure.
Figure 5B:
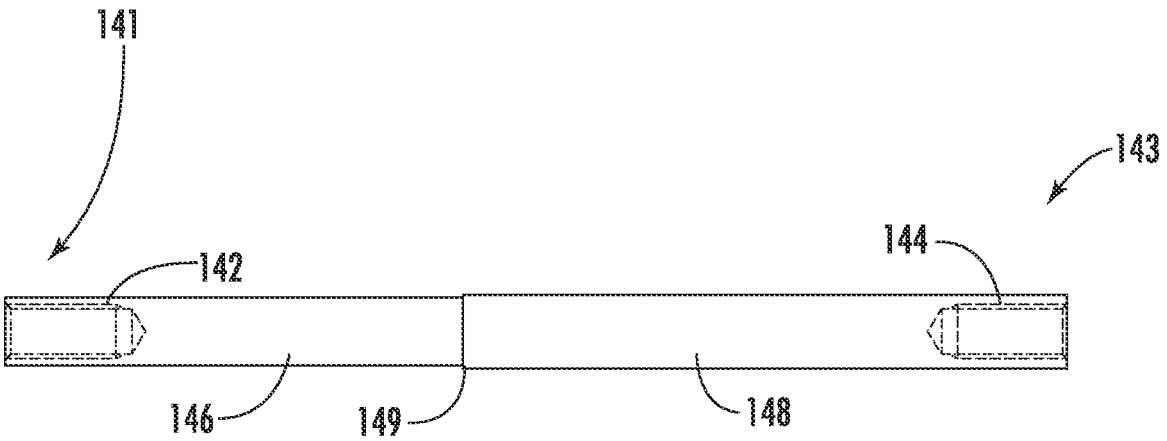
FIG. 5B is a side view of the threaded coupler of FIG. 5A.

FIG. 4E illustrates a brace assembly 118B according to another embodiment. The brace assembly 118B may be substituted for one or more of the brace assemblies 118, 138, 158. The brace assembly 118B is similar to the brace assemblies 118 described above with reference to FIGS. 4A-4C, and like components are given corresponding reference numbers.

The brace assembly 118B includes two coupler assemblies 162 that are spaced in a height direction of the riser plate 127 and centered along the width of the riser plate 127. In addition, the illustrated brace assembly 118B includes a rebar stub 176 extending from one side of the riser plate 127 between the two coupler assemblies 162. The rebar stub 176 may provide an attachment point to facilitate joining the rebar grid 114 to the riser plate 127. Furthermore, the riser plate 127 is centered on the foot plate 125 in the illustrated embodiment; however, the riser plate 127 may alternatively be coupled to an end of the foot plate 125.

Figure 6:
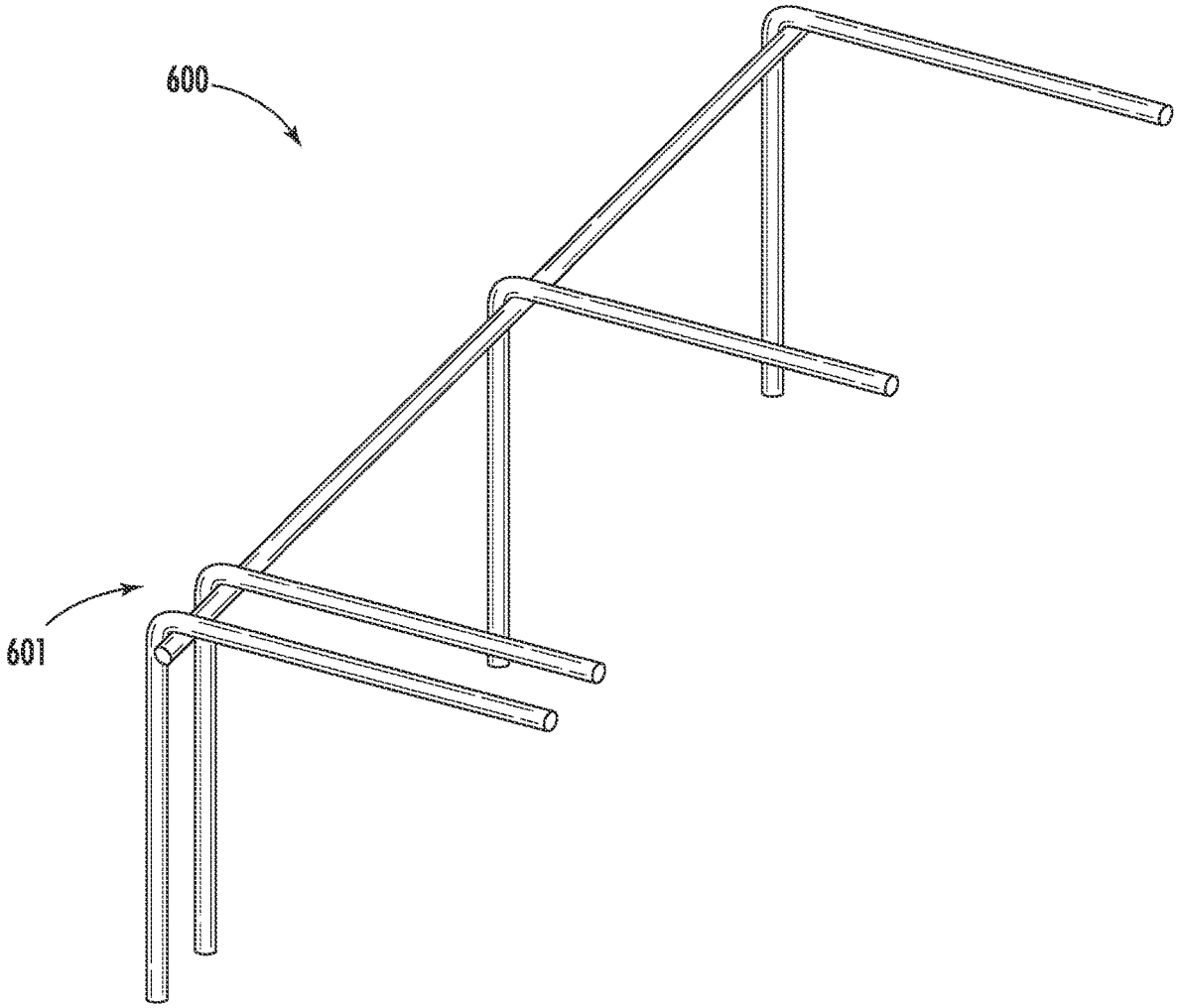
FIG. 6 is a perspective view of rebar components of a portion of a modular spa frame according to embodiments of the present disclosure.

FIG. 6 illustrates a perspective view of rebar components 600 of a portion of the modular spa frame 100. In the embodiment of FIG. 6, rebar components are positioned adjacent to one another, such as those of portion 601 of FIG. 6, and overlap one another.

Figure 7:
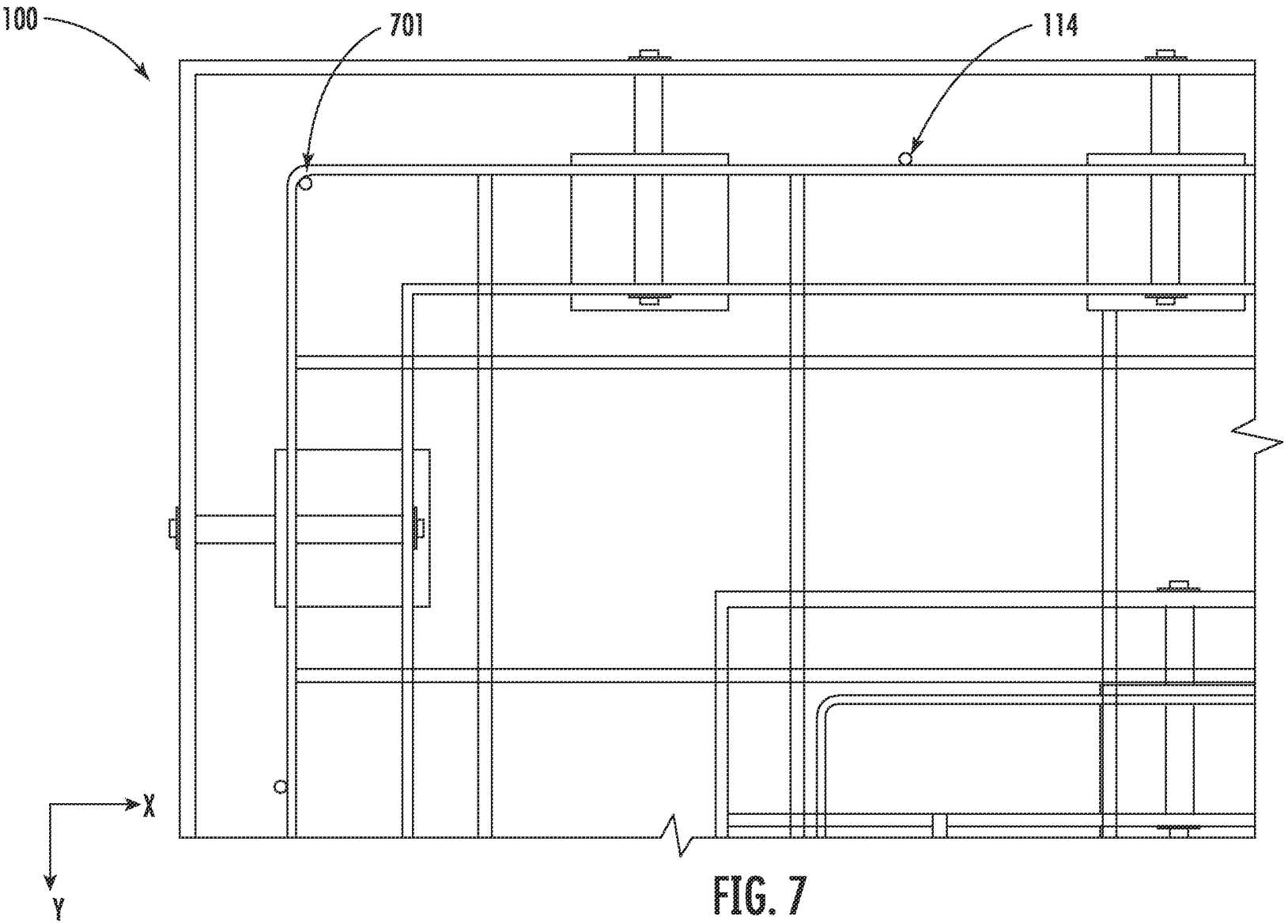
FIG. 7 is a top-view of a corner portion of a modular spa frame according to embodiments of the present disclosure.

FIG. 7 shows a top-view of a portion of the modular spa frame 100, illustrating a corner 701 formed by the outer frame rebar grid 114. In the illustrated embodiment, the outer frame brace assemblies 118 are each spaced from the corner 701 of the outer frame rebar grid 114 by about one foot.

Figure 8:
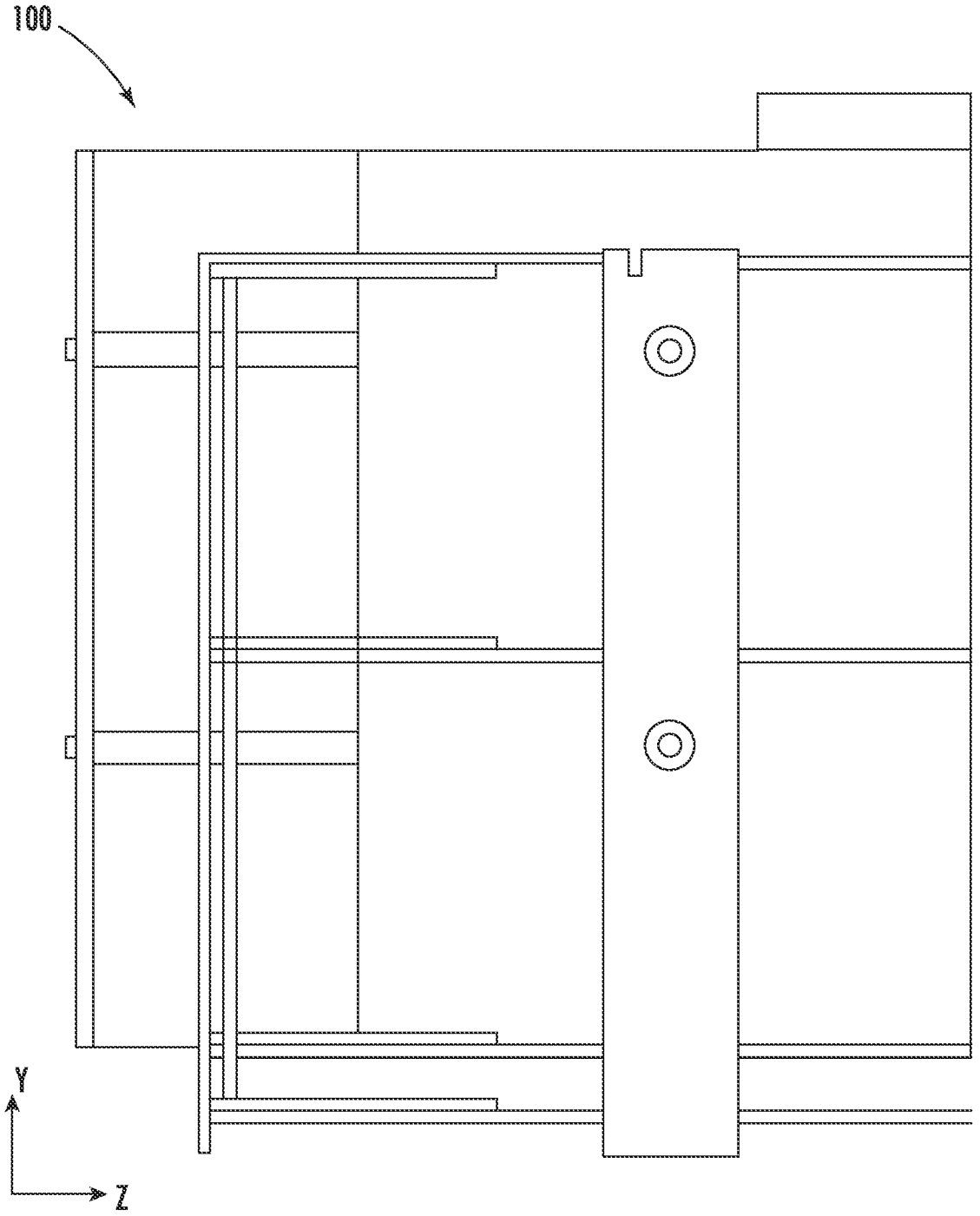
FIG. 8 is a side-view of a portion of a modular spa frame according to embodiments of the present disclosure.

FIG. 8 shows a side-view of a portion of the modular spa frame 100, showing several overlapping rebar components and further wall to floor details.

Figure 9A:
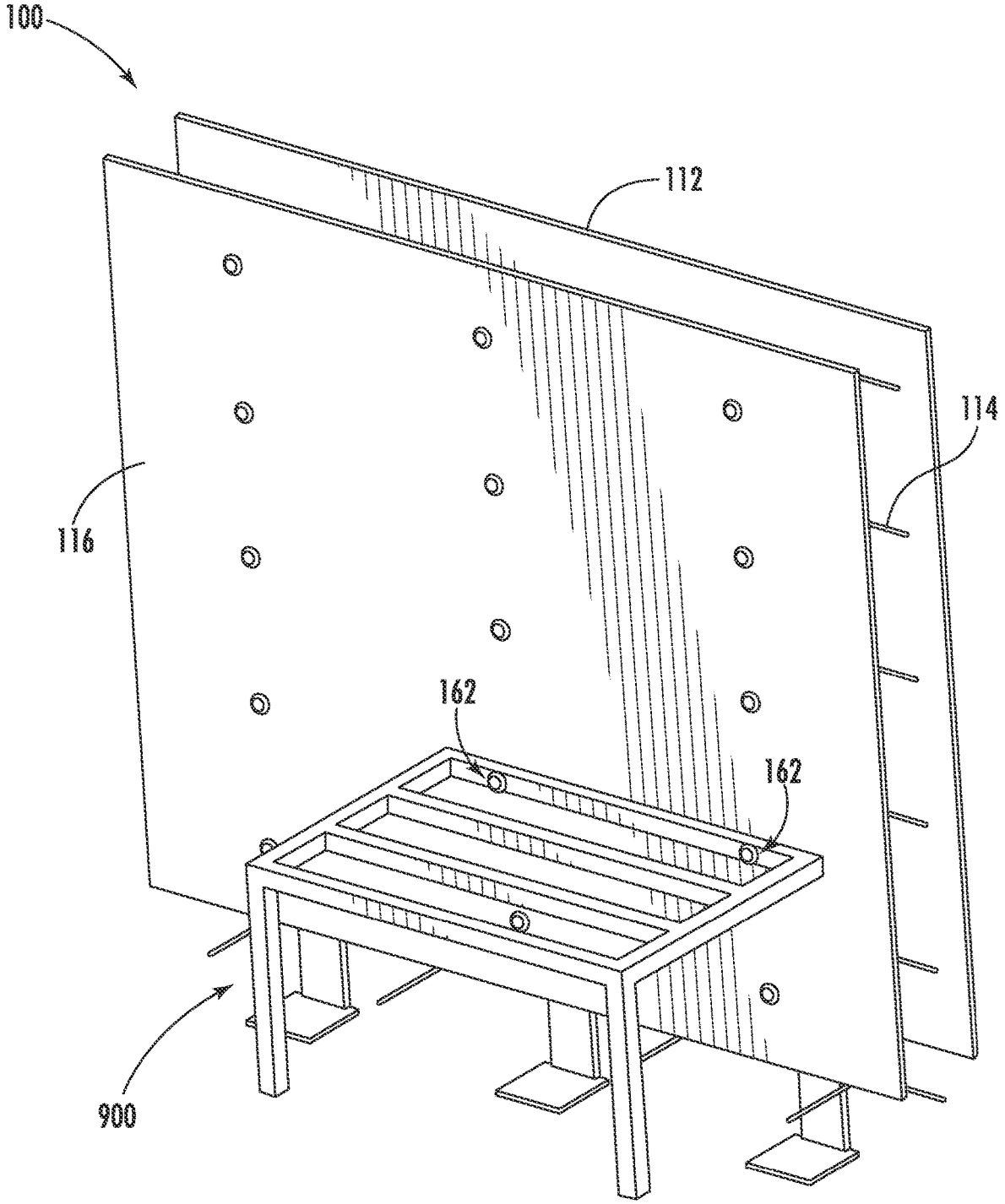
FIG. 9A illustrates a portion of a modular spa frame according to another embodiment.
Figure 9C:
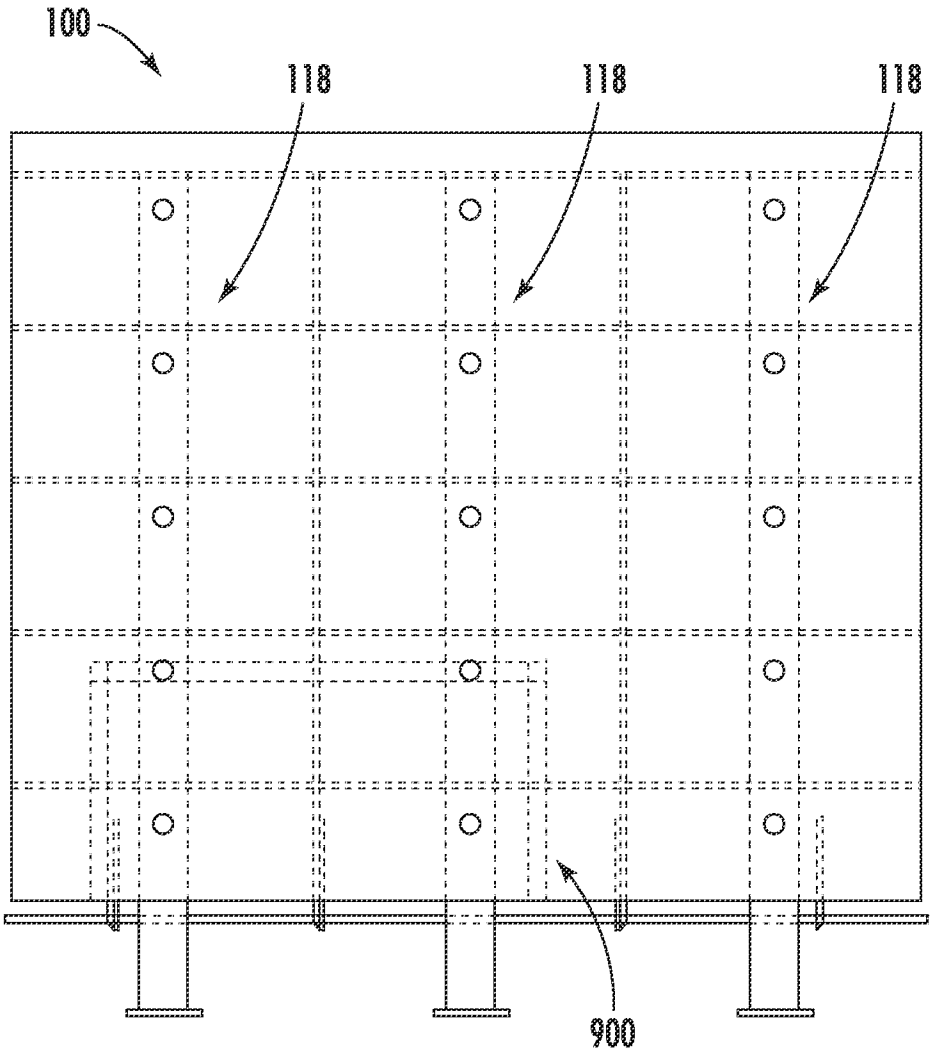
FIG. 9C illustrates brace assemblies of the modular spa frame of FIG. 9A.
Figure 9B:
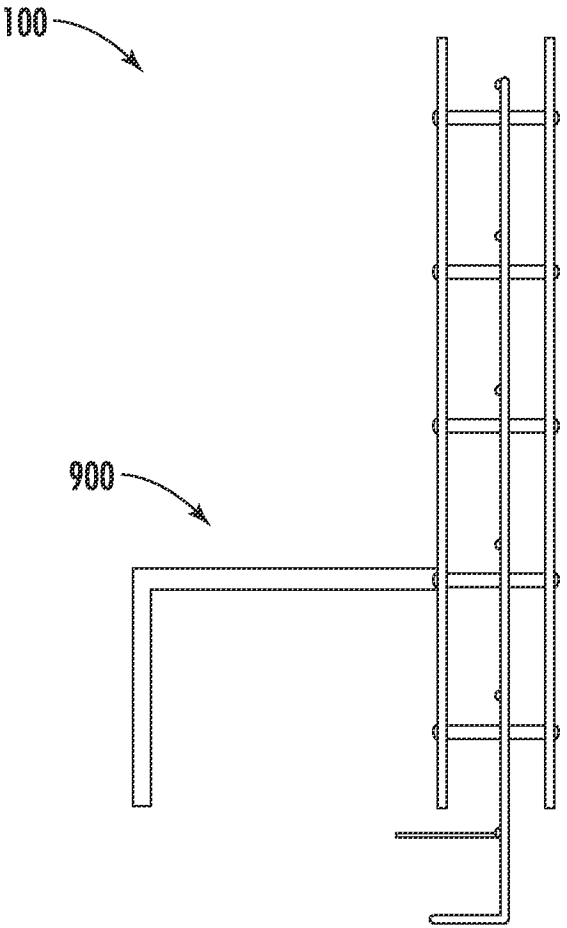
FIG. 9B is a side view illustrating the portion of the modular spa frame of FIG. 9A.

FIGS. 9A-C illustrate a taller frame portion 101 that may be incorporated into the modular spa frame 100. In the illustrated embodiment, the frame portion 101 includes greater number of coupler assemblies 162 (i.e. five coupler assemblies 162 on each brace assembly 118 in the illustrated embodiment). In addition, a sub-frame 900 is coupled to the inner panel 116. In the illustrated embodiment, two of the coupler assemblies 162 extend through the sub-frame 900 to couple the sub-frame 900 to the inner panel 116. The sub-frame 900 may be used to form a seat or step in the spa, for example. In other embodiments, the sub-frame 900 may be coupled to the inner panel 116, the rebar grid 114, and/or the outer panel 112 in other ways.

In one embodiment, one or more components of the modular spa frame 100 are coated with a material, such as a rust mitigation or rust prevention substance. For example, components such as the foot plate 125, the riser plate 127, and the bolts 166, 168, and/or the threaded couplers 140 may be coated with a protective coating.

In one embodiment, the modular spa frame 100 is configured to receive poured concrete. For example, concrete may be poured (including pneumatic application) into a volume defined between the outer frame outer panel 112 and the outer frame inner panel 116 to encase the outer frame rebar grid 114. This forms a concrete outer frame wall. Concrete may also be poured into a volume defined between the medial frame outer panel 132 and the medial frame inner panel 136 in encase the medial frame rebar grid 134. This forms a concrete medial frame wall. Concrete may also be poured into a volume defined on the inside of the inner frame outer panel 152 to encase the inner frame rebar grid 154. This may form a floor of the spa, for example. In one embodiment, the modular spa frame 100 does not require exterior plumbing to service a spa fitted with the modular spa frame 100. That is, plumbing can be accommodated between the outer frame wall and the medial frame wall.

The modular spa frame system as disclosed provides several benefits over existing spa frames and methods of constructing spa frames. As mentioned above, traditional construction of walled systems can be labor intensive and relatively costly, due to in-situ construction difficulties and processes, and can present wide variation in quality and standards. The disclosure solves the limitations of existing walled systems for spa structures by utilizing a modular construction approach.

The modular construction approach of the disclosure provides a more efficient and effective spa frame. The modular spa frame system of the disclosure is more efficiently constructed (efficient with respect to, e.g., cost of construction, time of construction, and ease of construction) through use of modular components. Because the components of the modular spa frame system are standardized and pre-fabricated off-site (from the construction site), the components are of reduced cost. For example, by producing components in volume, the cost per component unit is reduced relative to one-off or specialized components. Also, the time of construction on-site is reduced because the components are familiar and unchanged from one installation site to another. Thus, an installation crew spends less time in constructing the modular spa frame system of the disclosure relative to traditional spa frames. Furthermore, a standardized crew may assemble the modular spa frame system, rather than the traditional approach of spa construction requiring a "stage by stage" construction by a series of specialized tradesmen.

Also, the modular spa frame system 100 and associated method of construction produces a more effective spa frame system in that it yields a highly repeatable spa frame system, given the modular components are standardized and the method of assembling the components is standardized. Thus, the assembled spa frame system of the disclosure is more predictable, and of higher quality, than traditional spa frame systems which vary in quality and standards depending on, for example, crew familiarity with components and methods of construction, and quality of one-off or components manufactured in small volumes.

An example use case of one embodiment of a method of construction of a modular spa, such as that described above with respect to one or more of FIGS. 1A-9C, is described below.

First, a user obtains a kit containing the modular components described herein for constructing a spa. The kit may advantageously be shipped flat on pallets. Next, a site is prepared by leveling a pad area. An outline of the spa may then be staked out using rebar stakes, which may be supplied in the kit. Excavation may then occur to a depth of 24-inches in some embodiments, for placement of the spa. The floor may be leveled after excavation with sand and/or gravel.

Next, the interior frame 150 is assembled and leveled, followed by the medial frame 130 and the outer frame 110. The frames 110, 130, 150 may include pre-designated points for jet piping (e.g., 1-inch jet piping). In some embodiments, a seat wall may be formed with 90-degree jets. The foot plates 125 of the brace assemblies 118, 138, 158 facilitate assembly of the frames 110, 130, 150 because they allow the frames to stand freely. The foot plates 125 also facilitate leveling the respective frames 110, 130, 150, because shims can be readily inserted under the foot plates 125.

Finally, concrete is applied into each of the frames 110, 130, 150. The concrete may be poured or pneumatically applied. The coupler assemblies 162 hold the frame panels 112, 116, 132, 136, 152 in position against the pressure exerted on the panels by the weight of the concrete. Once the concrete has hardened, the threaded bolts 164, 168 may be removed. The panels 112, 116, 132, 136, 152 may then be conveniently removed.

Figure 10:
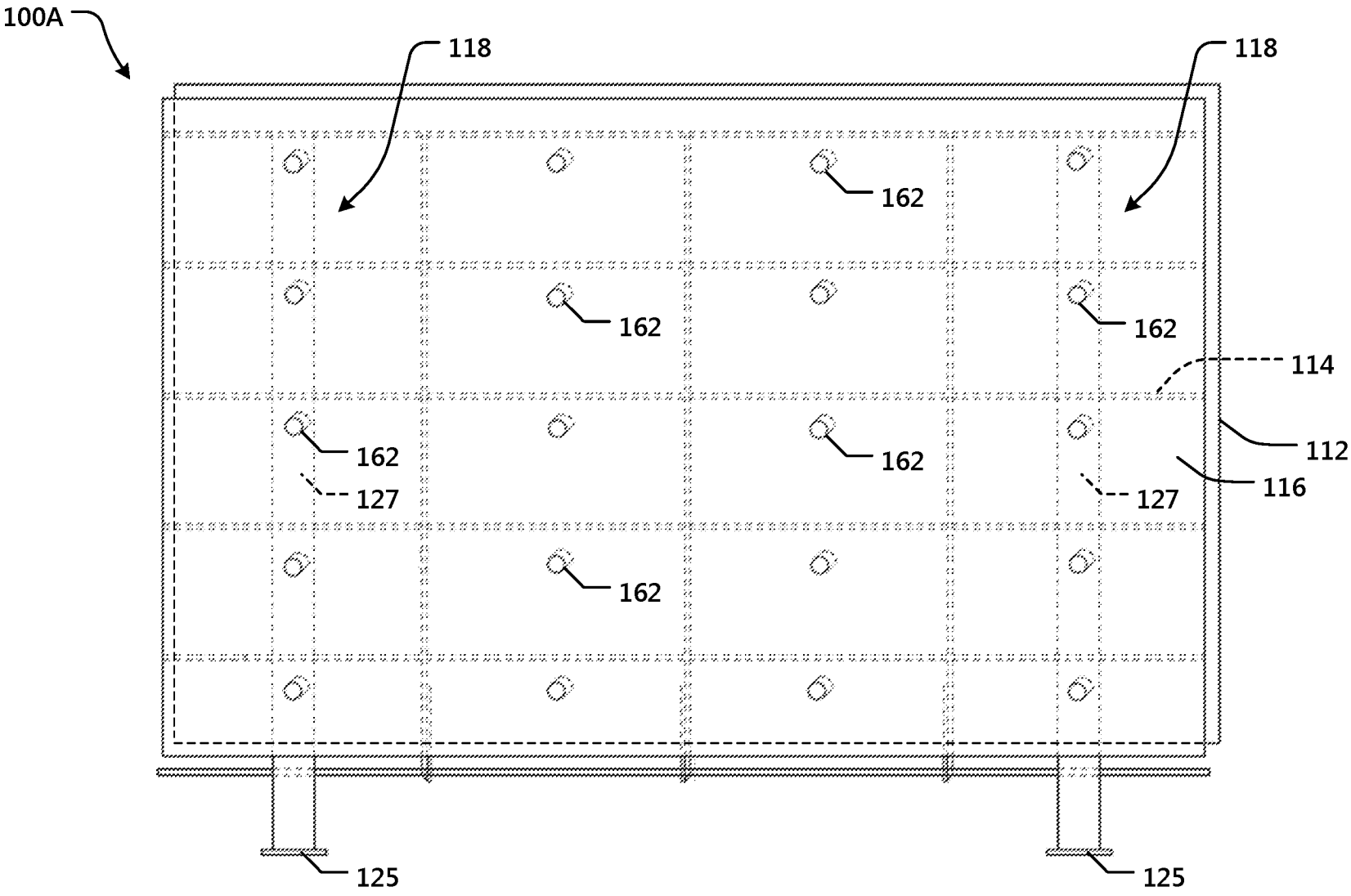
FIG. 10 is a perspective view illustrating a portion of a modular spa frame according to another embodiment.

FIG. 10 illustrates a portion of a modular spa frame system 100A according to another embodiment. The construction of the modular spa frame system 100A is similar to the embodiments described above with reference to FIGS. 1A-9C, except the modular spa frame system 100A includes additional (i.e. a second plurality of) coupler assemblies 162 separate from the brace assemblies 118. That is, the additional coupler assemblies 162 include threaded couplers 140 that do not extend through the riser plates 127 of the brace assemblies 118.

For example, in the illustrated embodiment, the modular spa frame system 100A includes an outer panel 112, an inner panel 116, and first and second brace assemblies 118 with riser plates 127 extending into a volume defined between the inner panel 116 and the outer panel 112. Each of the brace assemblies 118 includes a plurality of coupler assemblies 162 that couples the panels 112, 116 to the respective riser plates 127 generally in the manner described above. Additional coupler assemblies 162 extend between the outer panel 112 and the inner panel 116 at positions between the brace assemblies 118 along the length of the wall section. In some embodiments, the additional coupler assemblies 162 may be arranged in an array of rows and columns. In some embodiments, each wall section of the modular spa frame system 100A may include two brace assemblies 118 positioned adjacent the ends of the wall section and a plurality of coupler assemblies 162, without associated brace assemblies 118, at positions between the two brace assemblies 118.

The additional coupler assemblies 162 provide a strong connection between the inner and outer panels 112, 116 capable of resisting the pressure that concrete exerts on the panels when poured into the volume. This may be particularly advantageous when the modular spa frame system 100A is used to construct relatively larger walls. Because the additional coupler assemblies 162 are not associated with respective brace assemblies 118, however, the cost, size, and weight of the modular spa frame system 100A is reduced.

In some embodiments, the panels 112, 116 may be predrilled with holes to accommodate the coupler assemblies 162. In other embodiments, a user may drill holes into the panels 112, 116 on site.

A number of variations and modifications of the disclosure can be used. It would be possible to provide for some features of the disclosure without providing others.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

Various features of the disclosure are set forth in the following claims.

What is claimed is:

1. A wall construction system comprising:
an outer panel;
an inner panel spaced from the outer panel to define a volume between the inner panel and the outer panel;
a rebar grid disposed in the volume between the outer panel and the inner panel; and
a brace assembly including
a riser plate extending between the outer panel and the inner panel, and
a plurality of coupler assemblies configured to couple the outer panel and the inner panel to the riser plate,
wherein the volume is configured to receive concrete such that the concrete encases the rebar grid and forms a reinforced concrete wall between the inner panel and the outer panel.

2. The wall construction system of claim 1, wherein each of the coupler assemblies includes a threaded coupler extending through the riser plate.

3. The wall construction system of claim 2, wherein each of the coupler assemblies includes a first bolt threadably coupled to a first end of the threaded coupler and a second bolt threadably coupled to a second end of the threaded coupler.

4. The wall construction system of claim 3, wherein each of the coupler assemblies includes a non-metallic spacer surrounding at least a portion of the threaded coupler.

5. The wall construction system of claim 2, wherein each of the coupled assemblies includes a first spacer surrounding a first portion of the threaded coupler on one side of the riser plate and a second spacer surrounding a second portion of the threaded coupler on an opposite side of the riser plate.

6. The wall construction system of claim 1, wherein the rebar grid is fixed to the riser plate.

7. The wall construction system of claim 1, wherein the brace assembly includes a foot plate, and wherein the riser plate is coupled to the foot plate.

8. The wall construction system of claim 1, wherein the outer panel and the inner panel each comprise a sheet of material.

9. The wall construction system of claim 1, further comprising a protective coating.

10. A wall construction system comprising:
a plurality of panels at least partially defining a volume;
a plurality of brace assemblies, each brace assembly including
a riser plate, and
a plurality of coupler assemblies connecting the plurality of panels to the riser plate, each coupler assembly including a threaded coupler, a bolt, and a spacer surrounding at least a portion of the threaded coupler; and
a rebar grid positioned within the volume,
wherein the volume is configured to receive concrete such that the concrete encases the rebar grid and forms a reinforced concrete wall against the panels.

11. The wall construction system of claim 10, wherein each of the plurality of panels comprises a sheet of material.

12. The wall construction system of claim 10, wherein the plurality of panels includes an inner panel and an outer panel such that the volume is defined between the inner panel and the outer panel.

13. The wall construction system of claim 10, wherein each brace assembly includes a foot plate coupled to the riser plate.

14. The wall construction system of claim 10, wherein the rebar grid is fixed to the riser plate.

15. The wall construction system of claim 10, wherein the threaded coupler extends through the riser plate.

16. A wall construction system comprising:
a plurality of panels at least partially defining a volume, the plurality of panels including a first panel and a second panel;
a brace assembly including
a foot plate,
a riser plate extending perpendicularly from the foot plate, and
a plurality of coupler assemblies configured to couple the first panel and the second panel to the riser plate, each coupler assembly of the plurality of coupler assemblies including a threaded coupler extending through the riser plate,
wherein the volume is configured to receive concrete to form a concrete wall against the first panel and the second panel, and
wherein the coupler assemblies are configured to hold the first panel and the second panel in position relative to the riser plate against pressure exerted on the first panel and the second panel by the concrete during solidification of the concrete.

17. The wall construction system of claim 16, wherein each of the plurality of panels comprises a sheet of material.

18. The wall construction system of claim 16, wherein the plurality of panels includes an inner panel and an outer panel such that the volume is defined between the inner panel and the outer panel.

19. The wall construction system of claim 16, further comprising a rebar grid positioned within the volume and fixed to the riser plate, wherein the rebar grid is configured to be encased by the concrete.

20. The wall construction system of claim 16, wherein each coupler assembly includes a plurality of bolts and a plurality of spacers.

* * * * *